US005568742A

United States Patent [19]

Bauer

[11] Patent Number: 5,568,742

[45] Date of Patent: Oct. 29, 1996

[54] APPARATUS FOR INTERNAL HIGH-PRESSURE FORMING

[75] Inventor: Anton Bauer, Schwalbach, Germany

[73] Assignee: Huber & Bauer GmbH, Dillingen, Germany

[21] Appl. No.: 375,590

[22] Filed: Jan. 19, 1995

[30] Foreign Application Priority Data

Jan. 29, 1994 [DE] Germany ..... 44 02 673.0

[51] Int. Cl.[6] ..... B21D 26/02; B21D 39/00

[52] U.S. Cl. ..... 72/61; 72/62

[58] Field of Search ..... 72/60, 61, 62, 72/63, 54

[56] References Cited

U.S. PATENT DOCUMENTS

| | | | |
|---|---|---|---|
| 3,740,985 | 6/1973 | Fuchs, Jr. | 72/60 |
| 4,317,348 | 3/1982 | Halene et al. | 72/62 |
| 5,303,570 | 4/1994 | Kaiser | 72/60 |
| 5,321,964 | 6/1994 | Shimanovski et al. | 72/60 |

FOREIGN PATENT DOCUMENTS

WO92/13656 8/1992 Germany .

*Primary Examiner*—David Jones
*Attorney, Agent, or Firm*—Darby & Darby, P.C.

[57] ABSTRACT

In an apparatus for molding particularly a tubular blank of a ductile metal with internal high pressure in a mold having a cavity, which apparatus has a pressure-medium connection, which can be advanced from one base (10) and can be applied tightly against the one end of the tubular blank and a seal or a second pressure-medium connection, which can be advanced from a second base (11) and can be applied tightly against the other end, the mold or the pot (3) accommodating the mold has a circular cross section in the horizontal plane and, starting from the two bases (10; 11) with two tie rods (25; 26), a yoke (28; 29) is placed about the mold or the pot (3) and one (11) of the two bases can be moved on an arc (14) about the vertical axis (12) of the mold or the pot (3) and can be fixed at different places. The yokes (28; 29) are divided in two symmetrically to the horizontal sectional plane of the pressure-medium connection or seal assigned to them, the one yoke (29) lying in the other (28) and the connections (7; 8) of the pressure-medium connection and the seal or the second pressure-medium connection protruding with their bases (10; 11) in each case between the two parts of the other yoke (28; 29).

9 Claims, 2 Drawing Sheets

APPARATUS FOR INTERNAL HIGH-PRESSURE FORMING

Figure 1:
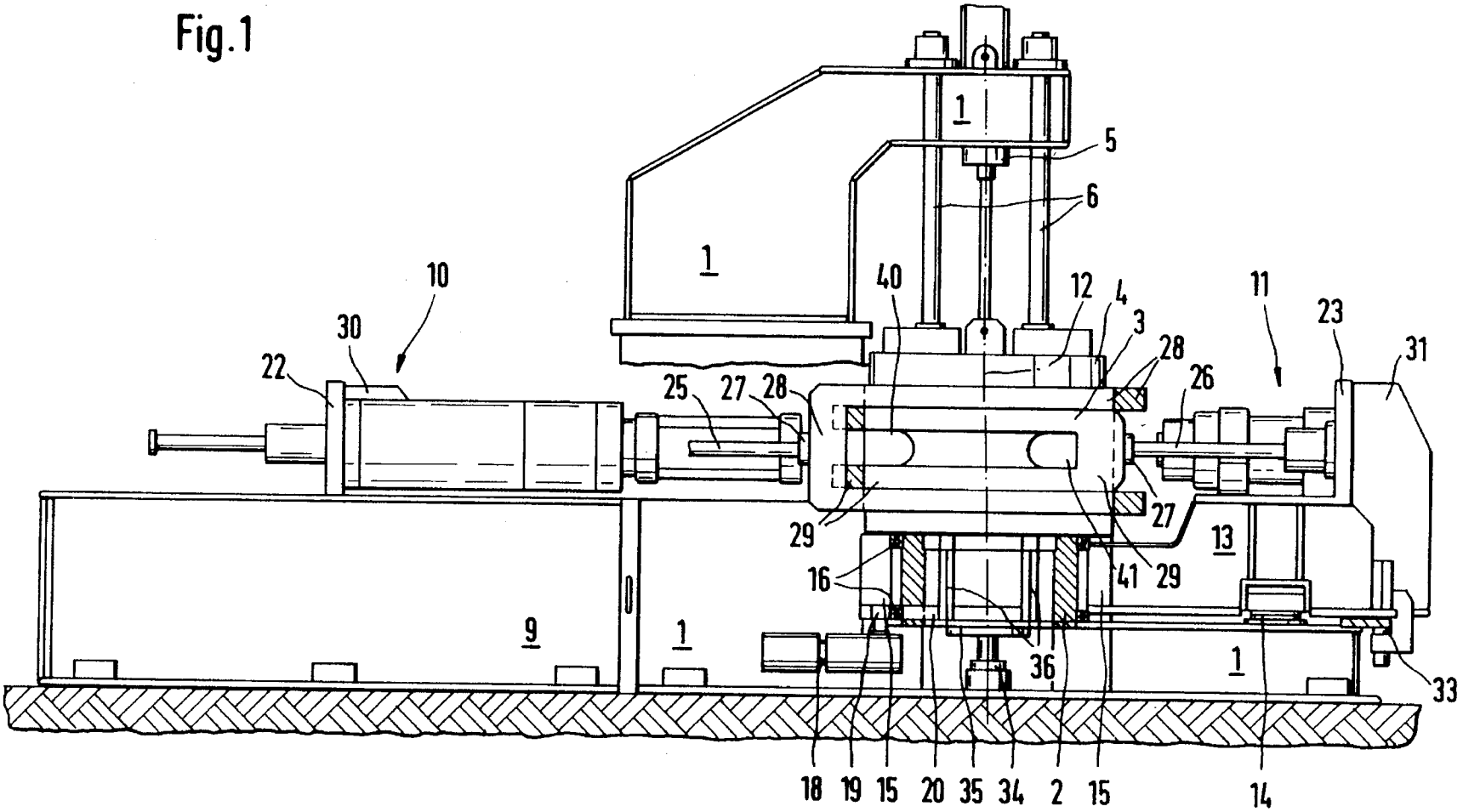

The invention relates to an apparatus for molding particularly a tubular blank of a ductile metal with internal high pressure in a mold, having a cavity, which apparatus has a pressure-medium connection, which can be advanced from one base and can be applied tightly against the one end of the tubular blank and a seal or a second pressure-medium connection, which can be advanced from a second base and can be applied tightly against the other end.

Since a positive connection does not come about when the pressure-medium connection or seal is applied, the appreciable forces of, for example 90 to 1,800 tons, which result from the high pressure of, for example, 300 to 6,000 bar, must be absorbed by the apparatus. If the tubular blank is linear, the forces at the mold cancel one another. In the case of an angled or curved blank, the resultant must be compensated for by appropriately supporting the mold. For different angular positions of the ends of the blank to one another, either this support must be able to act in different angles or it must be possible to bring the two bases into different angular positions symmetrical to the support.

It is therefore an object of the invention to provide an apparatus, which does justice to these requirements with the least possible expense.

Pursuant to the invention, this objective is accomplished by an apparatus of the initially named type owing to the fact that the mold or a pot accommodating the mold has a circular cross section in the horizontal plane and, starting from the two bases, a yoke having in each case two tie rods is placed about the mold or the pot and one of the two bases can be moved on an arc about the vertical axis of the mold or the pot and can be fixed at different places.

The force, resulting from the pressure-medium connection or the seal, is always compensated for directly here. The two yokes also always act together in said resultant. The basic frame of the apparatus does not have to transfer any supporting forces.

For the movement of the base and the yoke in different angular positions, made possible with the circular cross section of the mold or pot, a basic frame with an arc-shaped guiding device and stand device and, preferably, furthermore a displacing drive, is advisably provided.

Pursuant to a further development of the invention, the yokes are constructed, as a rule, in two parts symmetrically to the horizontal sectional plane of the pressure-medium connection or seal assigned to them, the one yoke lying in the other and the connections of the pressure-medium connection and the seal or the second pressure-medium connection with their bases protruding in each case between the two parts of the other yoke.

In principle, other constructions would also be possible, even though they are less advantageous. In any case, the yoke, which is disposed as inner yoke, instead of being divided into two, could also have individual recesses, through which the other pressure-medium connection or seal can be advanced. Without the guidance of forces symmetrical to said sectional plane and other compensation, both yokes could also be constructed in only one part and be disposed, for example, on different sides of said sectional plane as close as possible to it.

An embodiment of the invention is given in the drawings, in which

Figure 2:
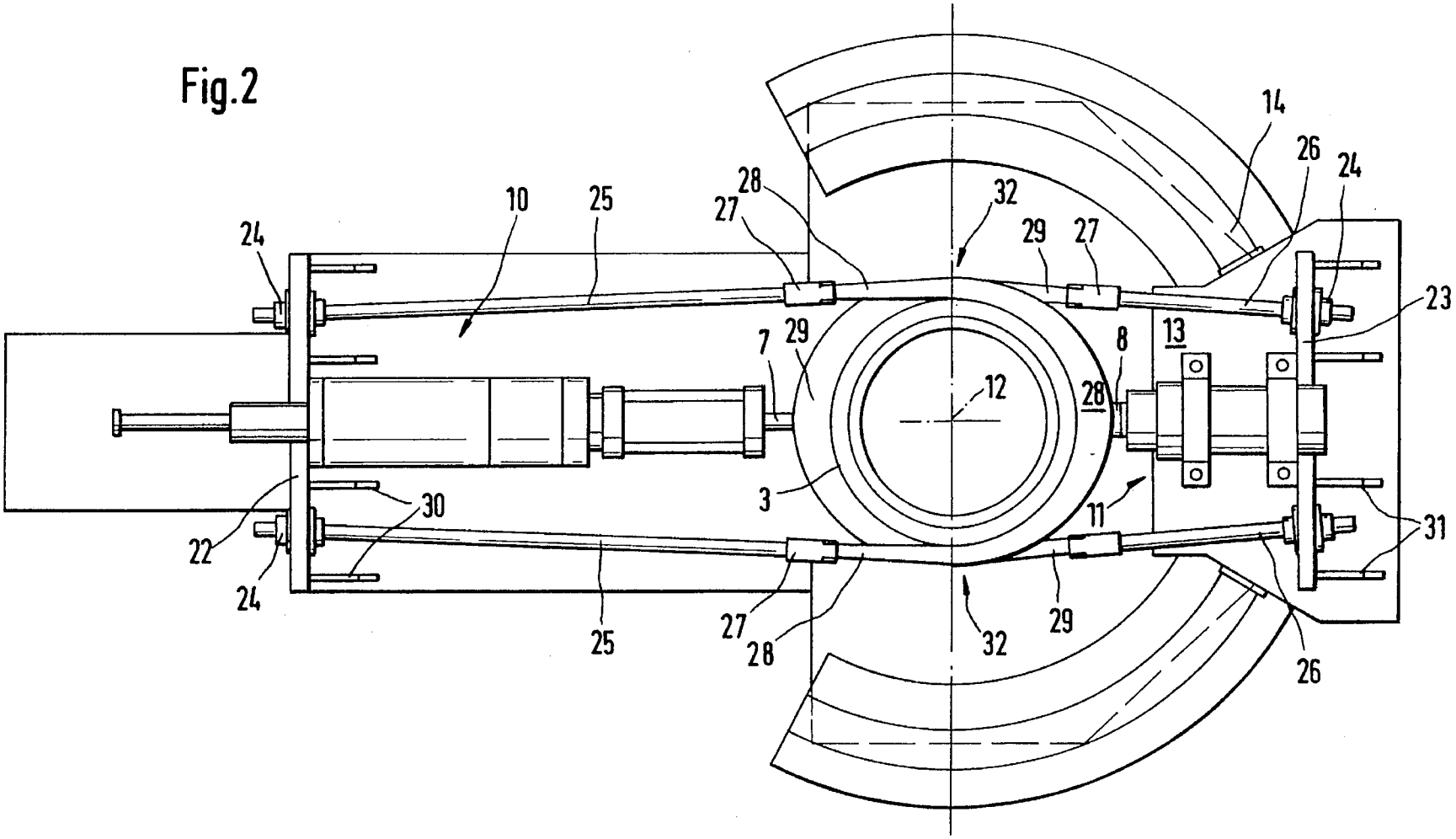

FIG. 1 shows a side view of an apparatus for internal, high-pressure molding, FIG. 2 shows a plan view of the apparatus, in which the upper parts have been omitted.

Both drawings are largely diagrammatic.

On an annular substructure 2 in a basic frame 1, which is essentially C-shaped, a pot 3 of circular cross section is disposed, which encloses without clearance a mold for the internal high-pressure molding of a likewise circular or rectangular cross section. The mold, which does not appear in the drawing, consists of a lower part and an upper part, which is connected with a lid 4 of the pot 3. The lid 4 and, with it, the upper part can be raised and lowered by a lifting cylinder 5 and, at the same time, guided by a guiding system of rods 6 in the basic frame 1. In the raised state of the lid 4 and the upper part, the blank can be inserted in the mold and the molded workpiece removed.

The blank is tubular. Both its ends are accessible through two openings in the mold and two elongated holes 40 and 41 in the wall of the pot 3 for a pressure-medium connection and a seal. The pressure-medium connection is to be imagined in the extension of a pressure-medium pipe 7 shown in FIG. 2 and the seal in the extension of a thrust piece 8.

The pressure-medium pipe 7 can be advanced from a base 10, which is disposed on an annex 9 of the basic frame 1 and includes a booster.

The thrust piece 8 can be advanced by a base 11, which is mounted on a movable trestle 13 that swivels about the axis 12 of the pot 3. The trestle 13 is mounted on an arc-shaped guiding and stand apparatus 14 provided on the basic frame 1; an extension 15 embraces with annular bearings 16 the ring-shaped substructure 2 of the pot 3, which forms a rigid part of the basic frame 1. The trestle 13 can be moved by a pinion gear. A pinion 19, driven by a gear motor 18, engages a circular toothed rack 20 mounted at the extension 15 of the trestle 13. Within the ring-shaped substructure 2, a ram plate 35 is disposed, which can be raised and lowered by a cylinder 34 and permits rams 36, which function in the mold, to be disposed, perhaps to impress a hollow into the workpiece after the high-pressure molding or slowly to release a cavity for forming a jacket piece during the action of the high pressure, etc.

The bases 10 and 11 are in each case provided at the back with a transverse plate 22 or 23 supported by stanchions 30 or 31. In each case, two tie rods 25 or 26 are fastened to the transverse plate 22 or 23 by means of turnbuckles 24. The tie rods 25 and 26 in each case hold with couplings 24 a yoke 28 or 29 placed about the pot 3.

The yokes 28 and 29 are divided at a short distance behind the couplings 27, that is, they appear to be fork-shaped in the view shown in FIG. 1. At the intersections 32 of the two yokes, the yoke 29 lies within the yoke 28. The pressure-medium pipe 7 protrudes between the two parts of the yoke 29 into the pot 3 and the thrust piece 8 protrudes between the two parts of the yoke 28.

The functions of the apparatus described and the significance of the design characteristics are evident from the explanations given further above. In addition, a clamping device 33 should be mentioned, by means of which the trestle 13 can be fixed in any position with the base 11.

I claim:

1. An apparatus for molding particularly a tubular blank of a ductile metal with internal high pressure comprising:

a pot having a vertical axis and a circular cross section in a horizontal plane and a cavity defined therein in which the blank is placed;

a first base;

a pressure-medium connection, advanceable from said first base and capable of being applied tightly against a first end of the tubular blank;

a first pair of tie rods extending from said first base;

a first yoke coupled to said first pair of tie rods and having an arcuate portion placed about said pot;

a second base;

a seal advanceable from said second base and capable of being applied tightly against the other end of the tubular blank;

a second pair of tie rods extending from said second base; and a second yoke coupled to said second pair of tie rods and having an arcuate portion placed about said pot;

wherein one of said two bases is movable along an arc about the vertical axis of said pot and capable of being fixed at a selected one of a plurality of places around the circumference of said pot.

2. The apparatus of claim 1, wherein said yokes are constructed in two parts symmetrical about a horizontal sectional plane, one of said yokes lying in the other said pressure-medium connection protruding between the two parts of said second yoke and said seal protruding between the two parts of said first yoke.

3. The apparatus of claims 1 or 2, further comprising a basic frame with an arc-shaped guiding device and stand device on which said movable base is positioned, and a displacing drive for moving said base.

4. The apparatus of claim 1, wherein second base is movable along an arcuate path to position said seal at a selected one of a plurality of positions around the circumference of said pot.

5. The apparatus of claim 1, wherein said movable base is maintained at a fixed distance away from said pot during movement along an arc about said pot.

6. The apparatus of claim 3, wherein said arc-shaped guiding device and stand device are substantially concentric with said pot.

7. An apparatus for molding a tubular blank of a ductile metal with internal high pressure comprising:

a mold having a vertical axis and a circular cross section in a horizontal plane and a cavity defined therein in which the blank is placed;

a first base;

a pressure-medium connection advanceable from said first base and capable of being applied tightly against a first end of said tubular blank;

a first pair of tie rods extending from said first base;

a first yoke coupled to said first pair of tie rods and having an arcuate portion placed about said mold;

a second base;

a seal advanceable from said second base and capable of being applied tightly against the other end of said tubular blank;

a second pair of tie rods extending from said second base; and a second yoke coupled to said second pair of tie rods and having an arcuate portion placed about said mold;

wherein one of said two bases is movable along an arc about the vertical axis of said mold and capable of being fixed at a selected one of a plurality of places around the circumference of said mold.

8. An apparatus for molding a tubular blank of a ductile metal with internal high pressure comprising:

a pot having a vertical axis and a circular cross section in a horizontal plane and a cavity defined therein in which the blank is placed;

a first base;

a first pressure-medium connection advanceable from said first base and capable of being applied tightly against a first end of said tubular blank;

a first pair of tie rods extending from said first base;

a first yoke coupled to said first pair of tie rods and having an arcuate portion placed about said pot;

a second base;

a second pressure-medium connection advanceable from said second base and capable of being applied tightly against the other end or said tubular blank;

a second pair of tie rods extending from said second base; and a second yoke coupled to said second pair of tie rods and having an arcuate portion placed about said pot;

wherein one of said two bases is movable along an arc about the vertical axis of said pot and capable of being fixed at a selected one of a plurality of places around the circumference of said pot.

9. An apparatus for molding a tubular blank of a ductile metal with internal high pressure comprising:

a mold having a vertical axis and a circular cross section in a horizontal plane and a cavity defined therein in which the blank is placed;

a first base;

a first pressure-medium connection advanceable from said first base and capable of being applied tightly against a first end of said tubular blank;

a first pair of tie rods extending from said first base;

a first yoke coupled to said first pair of tie rods and having an arcuate portion placed about said mold;

a second base;

a second pressure-medium connection advanceable from said second base and capable of being applied tightly against the other end of said tubular blank;

a second pair of tie rods extending from said second base; and a second yoke coupled to said second pair of tie rods and having an arcuate portion placed about said mold;

wherein one of said two bases is movable along an are about the vertical axis of said mold and capable of being fixed at a selected one of a plurality of places around the circumference of said mold.

* * * * *

UNITED STATES PATENT AND TRADEMARK OFFICE

CERTIFICATE OF CORRECTION

PATENT NO. : 5,568,742

DATED : October 29, 1996

INVENTOR(S) : Anton BAUER

It is certified that error appears in the above-indentified patent and that said Letters Patent is hereby corrected as shown below:

Title page, [30], Foreign Application Priority Data, change "44 02 673.0" to --P 44 02 673.0--.

Signed and Sealed this

Eighth Day of April, 1997

Bruce Lehman

*Attest:*

BRUCE LEHMAN

*Attesting Officer*

*Commissioner of Patents and Trademarks*